US005641736A

United States Patent [19]

Forbus

[11] Patent Number: 5,641,736

[45] **Date of Patent: *Jun. 24, 1997**

[54] SYNERGISTIC POUR POINT DEPRESSANT COMBINATIONS AND HYDROCARBON LUBE MIXTURES

[75] Inventor: T. Reginald Forbus, Newton, Pa.

[73] Assignee: Mobil Oil Corporation, Fairfax, Va.

[ * ] Notice: The term of this patent shall not extend beyond the expiration date of Pat. No. 5,488,191.

[21] Appl. No.: 536,503

[22] Filed: Sep. 28, 1995

[51] Int. Cl.[6] ..... C10M 143/06; C10M 143/08; C10M 145/22

[52] U.S. Cl. ..... 508/469; 585/10; 585/12

[58] Field of Search ..... 585/10, 12, 18; 508/469

[56] References Cited

U.S. PATENT DOCUMENTS

| | | | |
|---|---|---|---|
| 3,330,883 | 7/1967 | Giannetti et al. | 260/683.15 |
| 3,806,442 | 4/1974 | Reid et al. | 208/33 |
| 4,018,695 | 4/1977 | Heilman | 252/73 |
| 4,132,663 | 1/1979 | Heilman | 585/10 |
| 4,827,064 | 5/1989 | Wu . | |
| 4,827,073 | 5/1989 | Wu . | |
| 4,990,709 | 2/1991 | Wu . | |
| 5,276,227 | 1/1994 | Wu . | |
| 5,488,191 | 1/1996 | Chu et al. | 585/10 |

OTHER PUBLICATIONS

R.M. Mortier (1992) *Chemistry and Technology of Lubricants*, Blackie & Son (GB).

*Primary Examiner*—Prince Willis, Jr.
*Assistant Examiner*—Cephia D. Toomer
*Attorney, Agent, or Firm*—Malcolm D. Keen

[57] ABSTRACT

A synergistic mixture of pour point depressants is disclosed along with hydrocarbon lubricants containing same. The pour point depressant mixture is a mixture of a first PPD comprising a near linear copolymer of a mixture of ethylene and $C_3$–$C_{28}$ 1-alkenes, or only 1-alkenes, wherein a large proportion of the pendant alkyl groups of the recurring 1-alkene monomer units contain between 14 and 22 carbon atoms; and an additional conventional PPD, preferably polymethylmethacrylate. The copolymer is produced by polymerization of mixed 1-alkenes with reduced chromium oxide catalyst on silica support.

11 Claims, No Drawings

SYNERGISTIC POUR POINT DEPRESSANT COMBINATIONS AND HYDROCARBON LUBE MIXTURES

RELATION TO OTHER PATENT APPLICATIONS

This patent application is related to pending U.S. patent application Ser. No. 08/178,152 filed Jan. 6, 1994 now U.S. Pat. No. 5,488,191, incorporated herein by reference as to the production of mixed olefin pour point depressants.

FIELD OF THE INVENTION

This invention relates to novel pour point depressants and hydrocarbon lubricants mixtures containing novel pour point depressants (PPD). The invention particularly relates to the novel synergistic PPD mixture of conventional pour point depressants and pour point depressants produced by reduced chromium oxide catalyzed polymerization of mixed 1-alkenes rich in $C_{18}$+1-alkenes.

BACKGROUND OF THE INVENTION

The formulation of synthetic or mineral oil based lubricants typically includes an additive package incorporating a variety of chemicals to improve or protect lubricant properties in application specific situations, particularly internal combustion engine and machinery applications. The more commonly used additives include oxidation inhibitors, rust inhibitors, antiwear agents, pour point depressants, detergent-dispersants, viscosity index (VI) improvers, foam inhibitors and the like. This aspect of the lubricant arts is specifically described in Kirk-Othmer "Encyclopedia of Chemical Technology", 3rd edition, Vol. 14, pp477–526, incorporated herein by reference. The inclusion of additives in hydrocarbon lubricants provides a continuing challenge to workers in the field to develop improved additives of increased compatibility with the lubricant. Superior additives, while contributing their inherent attribute to the formulation, must do so while maintaining or improving upon the composite thermal and oxidative stability of the lubricant formulation.

The low temperature flow characteristic of hydrocarbon lubricants are typically improved by adding pour point depressants (PPD) to the formulation. At low temperatures, these additives modify the shape and size of the precipitating waxy hydrocarbon crystal to slow agglomeration and lower the effective pour point temperature of the lubricant formulation. Currently, preferred pour point depressants include polymethacrylates and ethylene-vinyl ester polymers. However, hydrocarbon based pour point depressants are known.

Polyalphaolefin (PAO) pour point depressants are described by Chong-Xiang Xiong in "The Structure and Activity of Polyalphaolefins as Pour Point Depressants", published in the Journal of the Society of Tribologists and Lubrication Engineers, March, 1993, pp 196–200. The PPD is prepared by polymerization of slack wax-derived $C_7$–$C_{20}$ alphaolefins using Ziegler-Natta catalyst. It is reported that PAO pour point depressant activity depends on average side chain length and on the distribution of the side chain length. Base oil characteristics influence the effectiveness of specific PAO pour point depressants.

It is also known that the low temperature flow properties of waxy distillate fuels can be improved by employing wax crystal modifiers as additives to fuels in a manner functionally similar to waxy lube PPD. The use of such additives to distillate fuels avoids the more costly step of deep dewaxing of the distillate feedstock.

One class of lubricants of particular interest in the present invention is synthetic lubricants obtained by the oligomerization of olefins, particularly $C_3$–$C_{20}$ alpha olefins. Catalytic oligomerization of olefins has been studied extensively. Known olefin oligomerization catalysts include the Ziegler-Natta type catalysts and promoted catalysts such as $BF_3$ or $AlCl_3$ catalysts. U.S. Pat. No. 4,613,712 for example, teaches the preparation of isotactic alpha-olefins in the presence of a Ziegler type catalyst. Other coordination catalysts, especially chromium on a silica support, are described in the art.

Recently, novel lubricant compositions (referred to herein as HVI-PAO and the HVI-PAO process) comprising polyalphaolefins and methods for their preparation employing as catalyst reduced chromium on a silica support have been disclosed in U.S. Pat Nos. 4,827,064 and 4,827,023, incorporated herein by reference in their entirety. The process comprises contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having low methyl to methylene branch ratios of less than 0.19 and pour point below −15° C. The process is distinctive in that little isomerization of the olefinic bond occurs compared to known oligomerization methods to produce polyalphaolefins using Lewis acid catalyst.

U.S. Pat. No. 5,146,021 to Jackson, et al. discloses lube compositions of HVI-PAO with mineral oil and polyolefins wherein oligomers from mixtures of $C_6$–$C_{20}$ alphaolefins are employed to provide high VI additives and shear stability. However, the patent does not claim or disclose the use of mixtures containing a high proportion of $C_{18}$+ alpha olefins to produce improved pour point depressants. U.S. Pat. No. 5,157,177 to Pelrine et al. discloses the oligomerization process relevant to the preparation of the foregoing HVI-PAO compositions. The compositions and process disclosed in these patents encompass polymer compositions that contain non-waxy components. The polymers are useful as lubricants with low pour point.

The object of the present invention is the production of novel lubricant additive hydrocarbon compositions that are highly effective as pour point depressants and/or combined pour point depressant and viscosity index improver (VII) acting alone or in combination with known PPDs.

Another object of the present invention is to provide improved lubricants containing the foregoing pour point depressants.

SUMMARY OF THE INVENTION

The present invention depicts a hydrocarbon lubricant additive mixture suitable as a lubricant pour point depressant that exhibits synergistic depression of a hydrocarbon lubricant pour point. The mixture comprises a first pour point depressant comprising the copolymer residue of a mixture of 1-alkene comonomers selected from the group consisting of $C_3$–$C_{28}$ 1-alkenes, wherein the copolymer contains at least 10 weight percent of recurring monomeric units of $C_{14}$–$C_{24}$ 1-alkenes. The copolymer also has a number average molecular weight between 5,000 and 60,000 and a molecular weight distribution between 1 and 10. The additive mixture further contains at least one additional pour point depressant selected from the group consisting of polymethacrylates and vinyl acetates.

The invention further comprehends hydrocarbon lubricants having a reduced pour point wherein the lubricant comprises a lubricant basestock and a synergistic mixture of pour point depressants. The pour point depressants comprise a first pour point depressant comprising a near-linear liquid hydrocarbon copolymer comprising poly(1-alkene) and containing between 300 and 4500 carbon atoms. The recurring monomeric units of the copolymer comprise a mixture of olefins selected from the group consisting of ethylene and $C_3$–$C_{28}$ 1-alkenes and at least 10 weight percent of the pendant chains of the copolymer contain between 12 and 22 carbon atoms. Further, at least one additional pour point depressant selected from the group consisting of polymethacrylates and vinyl acetates is included.

The superior pour point depressant properties of the compositions of the invention are preferably achieved by preparing the copolymers from a feedstream mixture of ethylene and $C_3$–$C_{28}$ 1-alkenes, or only $C_3$–$C_{28}$ 1-alkenes, wherein the distribution of carbon numbers is bimodal instead of monomodal. Bimodal distribution in the present invention means that carbon number distribution in the total feedstream is skewed in such a manner as to exhibit two peaks, one peak of low carbon number and another peak of high carbon number. The bimodal feedstream produces the bimodal 1-alkene copolymers of the present invention comprising copolymers having a first maximum of pendant carbon chains with between one and 12 carbon atoms and a second maximum of pendant carbon chains with between twelve and twenty-four carbon atoms.

In comparison to pour point depressants known in the art, the novel hydrocarbon oligomers of the invention show a dramatic capability to reduce the low temperature pour point of mineral oils and synthetic oils.

The copolymer oligomers of the invention are cited herein as mixed alpha-olefin HVI-PAO, or MHVI-PAO, to distinguish them over the HVI-PAO oligomers of the prior art.

The products of the invention are prepared by oligomerizing olefins, preferably a mixture of $C_6$–$C_{24}$ 1-alkenes containing at least 10 weight percent of $C_{14}$–$C_{24}$ 1-alkenes, preferably $C_{16}$–$C_{20}$ 1-alkenes, in contact with supported reduced valence state chromium oxide catalyst.

More particularly, a hydrocarbon lubricant additive has been discovered that is suitable as a pour point depressant. The additive comprises the copolymer residue of a mixture of 1-alkene comonomers selected from the group consisting of $C_3$–$C_{28}$ 1-alkenes. The copolymer contains at least 10 weight percent of $C_{14}$–$C_{24}$ 1-alkenes, but preferably 20 weight percent. It also has a number average molecular weight between 5,000 and 60,000; and a molecular weight distribution between 1 and 10.

The product copolymers of the invention are prepared by contacting a mixture of olefin comonomers selected from the group consisting of ethylene and $C_3$–$C_{28}$ 1-alkenes with a reduced valence state Group VIB metal catalyst on a porous support under copolymerization conditions. The mixture contains at least 10 weight percent of $C_{14}$–$C_{24}$ 1-alkenes, preferably $C_{16}$–$C_{20}$ 1-alkenes. The product of the copolymerization is separated and a copolymer comprising a PPD additive is recovered.

DETAILED DESCRIPTION OF THE INVENTION

The synergistic PPD mixture of the invention comprises a first pour point depressant comprising the copolymer residue of a mixture of 1-alkene comonomers in combination with conventional pour point depressants, particularly polymethacrylates.

Olefins useful as feedstock in the present invention to prepare the 1-alkene copolymer PPD include ethylene and $C_3$–$C_{28}$ 1-alkenes of odd and even carbon number. The preferred olefins are 1-alkenes, i.e., alpha-olefins selected from the group consisting of $C_6$–$C_{24}$ 1-alkenes. The preferred long chain 1-alkenes comprise $C_{14}$–$C_{24}$ α-olefins. The most preferred long chain 1-alkenes comprise $C_{16}$–$C_{20}$ α-olefins.

Feedstocks include mixtures of 1-alkene where the mixture of 1-alkenes comprise at least 10 weight percent $C_{16}$–$C_{24}$ 1-alkenes. The mixture may be a mixture of only two such 1-alkenes, for example, 1-hexene and 1-octadecene, 1-decene and 1-eicosene, or it may be a mixture that includes propylene, 1-butene, 1-pentene, 1-hexene, 1-heptene, 1-octene, 1-nonene, 1-decene, and higher 1-alkenes up to and including $C_{28}$ 1-alkene. In any event, at least 10 weight percent, but preferably 20 weight percent, of the 1-alkenes of the mixture will be 1-alkenes containing 16 to 24 carbon atoms.

The oligomerization reactions to prepare the 1-alkene copolymer PPD are catalyzed by supported metal oxide catalysts, such as Cr compounds on silica or other supported IUPAC Periodic Table Group VIB compounds as described in U.S. Pat. No. 4,827,064 to M. Wu. The catalyst most preferred is a lower valence Group VIB metal oxide on an inert support. Preferred supports include silica, alumina, titania, silica alumina, magnesia and the like. The support material binds the metal oxide catalyst. These porous supports may be in powder form or in extrudate form. Those porous substrates having a pore opening of at least 40 angstroms are preferred.

The support material usually has high surface area and large pore volumes with average pore size of 40 to about 350 angstroms. The high surface area are beneficial for supporting a large amount of highly dispersive, active chromium metal centers and to give maximum efficiency of metal usage, resulting in very high activity catalyst. The support should have large average pore openings of at least 40 angstroms, with an average pore opening of >60 to 300 angstroms preferred. For this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$, CO or $H_2$ containing gas or metal alkyl containing compounds.

Alternatively, the Group VIB metal may be applied to the substrate in reduced form, such as CrII compounds. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours.

Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold it the catalyst excess to reduce the catalyst to a lower valence CrII state. Finally the catalyst is cooled down to room temperature and is ready for use.

Example 1 specifically illustrates the method for preparation of the catalyst employed in the present invention and disclosed in U.S. Pat. No. 4,827,064.

EXAMPLE 1

Catalyst Preparation and Activation Procedure 1.9 grams of chromium (II) acetate ($Cr_2(OCOCH_3)_4 2H_2O$) (5.58 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and is ready for use.

While providing oligomers having a very low branch ratio, the oligomerization of 1-alkenes with reduced chromium oxide catalyst on silica support also provides a highly uniform structural composition, particularly when compared to conventional polyalphaolefins produced by $BF_3$, $AlCl_3$ or Ziegler-type catalysis. HVI-PAO oligomers have been shown to have a very uniform linear side chain branch and contain regular head-to-tail connections. The oligomers are essentially linear. In addition to the structures from the regular head-to-tail connections, the backbone structures have some head-to-head connections.

It has been discovered that activated reduced chromium catalyst on $SiO_2$ support efficiently produces polymers with the right molecular weight range and chemical composition to form useful additives from wide mixtures of alphaolefins. The mixed olefin based HVI-PAO polymers show a very large pour point depressant effect when blended with wax containing lubricant basestocks. This result is evident while the mixed olefin based polymers also are effective as viscosity index improvers (VII). The mixed olefin based HVI-PAO produced from reduced chromium catalyst on $SiO_2$ support can also minimize wax formation when blended with diesel fuel. Thus, it can be used to improve the flow properties of waxy fuels at low temperature. Since HVI-PAO polymers are pure hydrocarbons they will have better thermal stability, oxidative stability and solubility in hydrocarbon lubricants and distillate fuels than commercial pour point depressants or wax crystallization modifiers. These commercial additives are mostly polymethacrylates or ethylene-vinyl ester copolymers.

Examples of specific lubricant base stocks for which the polymers of the invention are effective as pour point depressants are summarized as follows and their physical properties are presented in Table 1:

LN142-100", solvent neutral mineral base stock, available from Mobil Oil Corp. as product number 71326-3, produced by methyl ethyl ketone solvent dewaxing;

LN321-150", solvent neutral mineral base stock, produced by catalytic dewaxing;

HN339-700", heavy neutral mineral base stock, produced by catalytic dewaxing;

BS345—bright stock mineral oil, produced by catalytic dewaxing;

WHI-A, WHI-B stocks—derived from slack wax. The wax is hydroisomerized at high pressure, such as 1500–3000 psi over an amorphous catalyst or zeolite.

PAO-1, a 2 cS synthetic hydrocarbon poly-alpha-olefin fluid available from Mobil Chemical.

PAO-2, a 5.5 cS synthetic hydrocarbon poly-alpha-olefin fluid available from Mobil Chemical.

TABLE 1

| Base Stock Properties | | | | | |
|---|---|---|---|---|---|
| | | Viscosity, cS | | | Pour Point |
| Stock No. | Stock Type | 100° C. | 40° C. | VI | °C. |
| LN142 | mineral, solvent dewax | 4.19 | 21.23 | 97 | −14 |
| LN321 | mineral catalytic dewax | 4.61 | 24.1 | 106 | −3 |
| HN339 | mineral catalytic dewax | 13.08 | 138.53 | 86 | −12 |
| BS345 | mineral catalytic dewax | 30.2 | 460.62 | 94 | 4 |
| WHI-A | wax-isomerized, solvent dewax | 5.35 | 26.1 | 144 | −16 |
| WHI-B | wax-isomerized, solvent dewax | 5.14 | 24.16 | 148 | −15 |

The process and compositions of the 1-alkene copolymers PPD used in the present invention are described by illustrating their preparation and properties in the following Examples 2–11. The Examples include the method for the preparation of the polymers of the invention (Example 2) and the properties of blends of the novel copolymers with various lubricant basestock (Examples 3–10). The catalyst used in the oligomerization of the mixed 1-alkene monomers is prepared according to the method described in Example 1. The results are shown in Table 2 for the preparation of the copolymer of the invention and Table 3 shows the properties of blends prepared from the copolymer with mineral oil and synthetic lubricants (Examples 2–9). EXAMPLE 2

Six grams of $Cr/SiO_2$ catalyst prepared as described in Example 1 were mixed with an alpha olefin mixture containing six to twenty carbon numbers and the mixture was stirred at room temperature for twenty-four hours. The alpha olefin mixture has a composition comparable to the alpha olefin mixture produced from a single stage ethylene growth reaction and is reported in Table 2. Gas chromatograph (GC) analysis of the polymer solution produced from the oligomerization reaction of alphaolefins showed that 70% to 90% of the alpha olefins were converted into polymers. The slurry mixture was very thick and 400 cc of xylene was added to dilute and quench the catalyst. The mixed olefin based HVI-PAO polymer was isolated by filtration to remove the catalyst, followed by distillation at 160° C. and 100 millitorr to remove solvent and any unreacted olefins. As shown in Table 1, the polymer composition contained different amounts of alphaolefins. All of the alphaolefins in the starting mixture were converted into polymer. The residual olefins were internal or branched olefins present in the starting mixture. This polymer had a number average molecular weight of 18,200, weight average molecular weight of 58,000 and molecular weight distribution of 3.19.

EXAMPLE 3

The sample prepared in Example 2 was blended with a light neutral paraffinic mineral base stock, LN321, which was dewaxed using a catalytic dewaxing process. The properties of the base stock and the blends are summarized in Table 3. These data show that the blend containing 0.26 weight percent of the product of Example 2 has a pour point of −38° C. and cloud point of 3.0° C., a 35° C. pour point reduction and 2.6° C. cloud point reduction compared to the starting base stock LN321. also the blend had higher VI than the base stock, i.e., 111 versus 106 for the base stock.

TABLE 2

Composition of Starting Olefin Mixtures and Polymers

| Carbon Number | Olefin MW | Wt % in Mix. | Wt % after 24 hrs | Conversion % | % Olefin in Polymer |
|---|---|---|---|---|---|
| 6 | 84 | 6.8 | 1.9 | 72 | 6 |
| 8 | 112 | 9.4 | 0.8 | 91 | 11 |
| 10 | 140 | 13.3 | 1.2 | 91 | 15 |
| 12 | 168 | 11.1 | 1.1 | 90 | 12 |
| 14 | 196 | 11.8 | 3.1 | 74 | 11 |
| 15 | 210 | 7.5 | 1.7 | 77 | 7 |
| 16 | 224 | 7.6 | 1.2 | 84 | 8 |
| 18 | 252 | 6.2 | 1.6 | 74 | 6 |
| 20 | 280 | 25.6 | 6.8 | 73 | 23 |
| 20+ | 282 | 0.7 | 0.4 | 43 | 0 |
| Polymer | — | 0 | 80 | — | — |

EXAMPLE 4

The same base stock used in Example 3 was blended with a commercial VI improver, Acryloid 956 (Example 4A), or commercial pour point depressant Acryloid 156 (Example 4C, and NALCO 5644 (Example 4B). The pour points of the blends were decreased only 2° to 26° C. and the cloud points remained the same as the base stock as shown in Table 3.

EXAMPLE 5

The product of Example 2 was blended with a mineral oil (LN142) which was prepared using a conventional solvent dewaxing process. The properties of the base stock and blends are summarized in Table 3. These data show that the blend containing 0.49 weight percent of the product of Example 2 had a pour point of −37° C. and cloud point of −12.9° C. This corresponds to a 23° C. pour point reduction and 3.5° C. cloud point reduction compared to the starting base stock. Also, the blend has higher VI than the base stock, 109 versus 97 for the stock.

EXAMPLE 6

A blend was prepared as described in Example 3, except the base stock was a heavy neutral mineral basestock HN339. The pour point of HN339 was depressed from −12° C. to −27° when 0.26 weight percent of the product of Example 2 was blended.

EXAMPLE 7

A blend was prepared as described in Example 3, except the base stock was mineral bright stock BS345. The pour point of BS345 was depressed from +4° C. to −12° C. when 0.55 weight percent of the product of Example 2 was added.

EXAMPLE 8

A blend was prepared as described in Example 3, except the base stock was prepared from a wax hydroisomerization process. In this case, the pour point was depressed from −15° C. to −23° C.

TABLE 3

| Example No. | Base oil Type | VII/PPD type | Wt % VII/PPD | Pour point, °C. | V@40° C., cS | V@100° C., cS | VI | Cloud Point °C. |
|---|---|---|---|---|---|---|---|---|
| No. 3 | LN321 | none | 0 | −3 | 24.1 | 4.61 | 106 | 5.6 |
| " | " | Exam. 2 | 0.26 | −38 | 24.81 | 4.74 | 111 | |
| " | " | " | 0.58 | −28 | 25.87 | 4.94 | 116 | 1.5 |
| No. 4 comparative | | | | | | | | |
| 4A | " | Acryloid 956 | 0.25 | −5 | 24.47 | 4.71 | 111 | 6.2 |
| 4B | " | Nalco-5644 | 0.26 | −26 | 24.15 | 4.63 | 107 | na |
| 4C | " | Acryloid 156 | 0.24 | −29 | 24.38 | 4.71 | 112 | na |
| No. 5 | LN142 | none | 0 | −14 | 21.32 | 4.19 | 97 | |
| " | " | Exam. 2 | 0.49 | −37 | 22.28 | 4.43 | 109 | −12.9 |
| " | " | " | 1.05 | −32 | 23.94 | 4.71 | 115 | −14.0 |
| No. 6 | HN339 | none | 0 | −12 | 138.53 | 13.08 | 86 | na |
| " | " | Exam. 2 | 0.26 | −27 | 140.53 | 13.45 | 89 | na |
| " | " | " | 0.5 | −29 | 143.35 | 13.68 | 90 | na |
| No. 7 | BS345 | none | 0 | 4 | 460.62 | 30.2 | 94 | na |
| " | " | Exam. 2 | 0.55 | −12 | 468.05 | 30.78 | 95 | na |
| " | " | " | 1.09 | −14 | 486.05 | 32.91 | 100 | na |
| No. 8 | WHI-A | none | 0 | −16 | 26.1 | 5.35 | 144 | 14.7 |
| " | " | Exam. 2 | 0.65 | −20 | 29.21 | 5.78 | 144 | −14.2 |
| " | " | " | 1.31 | −18 | 30.22 | 6.13 | 157 | −14.8 |
| No. 9 | PAO-1 | none | 0 | −66 | 5.2 | 1.7 | 90 | na |
| " | " | Exam. 2 | 0.51 | −78 | 5.47 | 1.82 | 106 | na |
| " | " | " | 1.73 | −69 | 6.39 | 2.13 | 144 | na |
| No. 10 | PAO-2 | none | 0 | −62 | 30.5 | 5.5 | 135 | na |
| " | " | Exam. 2 | 0.45 | −71 | 30.95 | 5.95 | 141 | na |
| " | " | " | 1 | −64 | 32.68 | 6.22 | 142 | na |

EXAMPLE 9

A blend was prepared as described in Example 3, except the base stock was a low viscosity polyalphaolefin product of 1.7 cS. A 12° C. pour point reduction was observed.

EXAMPLE 10

A blend was prepared as described in Example 3, except the base stock was a synthetic PAO base stock of 5.6 cS (stock 509). The pour point reduction was 9° C.

EXAMPLE 11

A two component HVI-PAO was prepared according to the general procedure described in Example 2. The components were 1-decene and 1-octadecene. Oligomers were prepared from feeds containing 7% 1-octadecene, 25% 1-octadecene and 40% 1-octadecene. When blends were prepared of mineral oil (LN321) containing the HVI-PAO oligomers, the corresponding pour point depression was −30° C. for 40% 1-octadecene, −13° C. for 25% 1-octadecene and −7° C. for 7% 1-octadecene.

The amount of pour point depression depends on the concentration of mixed HVI-PAO in the blend. The optimum concentration for the largest pour point depression is about 0.1 weight percent to about 0.4 weight percent. Usually the best results are achieved using 0.20–0.30 weight percent, preferably 0.25 weight percent. Above or below this concentration the amount of depression decreases. However, even at low concentrations in the range of 50–100 ppm a 5°–12° C. pour point depression is observed.

The copolymer oligomers effective as pour point depressants in the present invention comprise copolymers of $C_3$–$C_{28}$ 1-alkenes. The copolymer contains at least 10 weight percent of $C_{14}$–$C_{24}$ 1-alkenes; has a number average molecular weight between 5,000 and 60,000; a molecular weight distribution between 1 and 10.

An important part of the novelty of the 1-alkene copolymers used in the invention resides in the discovery that the copolymerization of certain mixtures of α-olefins according to the process of the invention leads to oligomers of unique structure (MHVI-PAO) with unexpectedly superior properties as pour point depressants and, even more notable, combined pour point depressants and viscosity index improves. The novel oligomers are produced from mixed α-olefin feedstock having a bimodal distribution of carbon numbers for the α-olefins. The distribution is such that the carbon numbers reach one maximum at a relatively high carbon number and another or second maximum at a relatively low carbon number. The preferred oligomers of the invention are characterized by exhibiting both maxima. This bimodal feedstream leads to the formation of oligomers of the present invention comprising copolymers having a first maximum of pendant carbon chains with between one and twelve carbon atoms and a second maximum of pendant carbon chains with between twelve and twenty-four carbon atoms. In terms of 1-alkene content, the oligomer or coploymer residue contains recurring units comprising a bimodal distribution of 1-alkenes having a first maximum between $C_3$ and $C_{14}$ 1-alkenes and a second maximum between $C_{14}$ and $C_{26}$ 1-alkenes.

Specifically preferred mixtures of 1-alkene monomers useful as feedstream for the 1-alkene copolymers used in the present invention include: $C_6$, $C_8$, $C_{10}$, $C_{12}$, $C_{14}$, $C_{15}$, $C_{16}$, $C_{18}$ and $C_{20}$ 1-alkenes; $C_6$ and $C_{18}$ 1-alkenes; $C_{10}$ and $C_{20-24}$ 1-alkenes; $C_{10}$ and $C_{20-28}$ 1-alkenes; $C_6$, $C_{16}$, $C_{18}$ and $C_{20}$ 1-alkenes, and $C_{10}$ and $C_{18}$ 1-alkenes.

Surprisingly, it has been discovered that the 1-alkene copolymers described above and employed as pour point depressants for hydrocarbon lubricants produce a synergistic effect in pour point depression when combined with conventional pour point depressants as PPD for hydrocarbon lubricants such that the mixture of the two pour point depressants to provide a given concentration of PPD produces a pour point depression greater than the same concentration of either PPD used alone in the lube.

Conventional pour point depressants that can be used in combination with the 1-alkene copolymer described herein to provide the synergistic effect in pour point depression are selected from any of the PPD used in the industry. The preferred conventional pour point depressants are esters of polymethacrylic acid, including $C_1$–$C_{20}$ alkyl esters of polymethacrylic. Other preferred pour point depressants known in the art are polyvinylalcohol, polyvinyl acetates and modified polyvinyl acetate.

Pour point depressants as employed in combination in the present invention to provide the described synergistic effect are used in concentrations between 0.01 and 10.0 weight percent in the lubricant. The weight ratio of the MHVI-PAO pour point depressant to the commercial pour point depressant, e.g.,polymethylmethacrylate or polyvinyl acetate, in the mixture is between 0.1 and 10.

EXAMPLE 12

A series of lubricant blends was prepared using hydrodewaxed furfural extracted Arab light feedstock plus a combination of 1-alkene copolymer ($C_6$-$C_{20}$ mixed olefin) and polymethacrylate as PPD. Pour points were determined for the blends and compared with the efficacy of the pour point depressants taken alone. The results are tabulated in Table 4.

EXAMPLE 13

A series of lubricant blends was prepared using hydrodewaxed furfural extracted Arab light feedstock plus a combination of 1-alkene copolymer different than those tested in Example 12 ($C_6$,$C_{16}$,$C_{18}$,$C_{20}$ mixed olefin) and polymethacrylate as PPD. Pour points were determined for the blends and compared with the efficacy of the pour point depressants taken alone. The results are tabulated in Table 5.

TABLE 4

Pour Point Depression of 40° F. Pour
Hydrodewaxed Arab Light
PPD 1: C6–C20 Mixed Olefin Co-Polymer
PPD 2: Polymethacrylate PPD (Concentration in Oil)

| | Herzog Pour Points in °F. PPD 2 (% by Weight of Concentrate) | | | | | |
|---|---|---|---|---|---|---|
| PPD 1 | NEAT | 0.20% | 0.35% | 0.50% | 0.75% | 1.00% |
| NEAT | 40 | 13 | 7 | 2 | −4 | −6 |
| 0.25% | 13 | −8 | −9 | −10 | | |
| 0.50% | 7 | | | −10 | | |
| 0.75% | −5 | −12 | −15 | −14 | | |
| 1.00% | −2 | | | | | |

TABLE 5

Pour Point Depression of 40° F. Pour
Hydrodewaxed Arab Light
PPD 1: C6,C16,C18,C20 Mixed Olefin Co-Polymer
PPD 2: Polymethacrylate PPD (Concentrate in Oil)

| | Herozog Pour Points in °F. PPD 2 (% by Weight of Concentrate) | | | | | |
|---|---|---|---|---|---|---|
| PPD 1 | NEAT | 0.20% | 0.35% | 0.50% | 0.75% | 1.00% |
| NEAT | 40 | 13 | 7 | 2 | −4 | −6 |
| 0.25% | 26 | 6 | | −8 | | |
| 0.50% | 9 | | | −11 | | |
| 0.75% | 8 | −11 | | −13 | | |
| 1.00% | 7 | | | | | |

What is claimed is:

1. A mixture of hydrocarbon lubricant pour point depressants that exhibits a synergistic pour point depressant effect, said mixture comprising a first pour point depressant comprising the copolymer residue of a mixture of 1-alkene comonomers selected from the group consisting of $C_3$–$C_{28}$ 1-alkenes, wherein said copolymer contains at least 10 weight percent of recurring monomeric units of $C_{14}$–$C_{24}$ 1-alkenes; has a number of average molecular weight between 5,000 and 60,000; a molecular weight distribution between 1 and 10; wherein said mixture further contains at least one additional pour point depressant wherein the additional pour point depressant is polymethacrylate; and said mixture contains the copolymer and the additional pour point depressant in a weight ratio of 0.1 to 10 (copolymer: additional pour point depressant) and exhibits a pour point depressant effect greater than the same concentration of either pour point depressant used alone.

2. The additive mixture of claim 1 wherein said copolymer residue contains a bimodal distribution of said 1-alkenes comprising a first maximum between $C_3$ and $C_{14}$ 1-alkenes and a second maximum between $C_{14}$ and $C_{26}$ 1-alkenes.

3. The additive mixture of claim 1 wherein said mixture of 1-alkenes comprises a bimodal mixture of $C_6$–$C_{24}$ 1-alkenes.

4. The additive mixture of claim 1 comprising the copolymer of 1-decene and 1-octadecene.

5. The additive mixture of claim 4 wherein the mole ratio of 1-decene to 1-octadecene is about 3 to 2.

6. A hydrocarbon lubricant having a reduced pour point, said lubricant comprising a lubricant basestock and from 0.01 to 10 weight percent of a synergistic mixture of pour point depressants comprising a first pour point depressant comprising a near-linear liquid hydrocarbon copolymer comprising poly(1-alkene) and containing between 300 and 4500 carbon atoms, wherein recurring monomeric units of said copolymer comprise a mixture of olefins selected from the group consisting of ethylene and $C_3$–$C_{28}$ 1-alkenes and at least 10 weight percent of the pendant chains of said copolymer contain between 12 and 22 carbon atoms; and at least one additional pour point depressant, wherein the additional pour point depressant is polymethacrylate; and said mixture contains the copolymer and the additional pour point depressant in a weight ratio of 0.1 to 10 (copolymer: additional pour point depressant) wherein said synergistic mixture exhibits a pour point depressant effect on said hydrocarbon lubricant greater than the same concentration of either pour point depressant used alone.

7. The lubricant of claim 6 wherein said wherein said recurring units comprise a mixture of $C_6$–$C_{24}$ 1-alkenes.

8. The lubricant of claim 6 wherein said copolymer comprises recurring units of 1-decene and 1-octadecene.

9. The lubricant of claim 6 wherein said lubricant basestock comprises mineral oil.

10. The lubricant of claim 6 wherein said lubricant basestock comprises poly(α-olefins).

11. The lubricant of claim 9 wherein said mineral oil is selected from the group consisting of solvent dewaxed mineral oil, catalytic dewaxed mineral oil and solvent dewaxed wax-isomerized mineral oil.

* * * * *